US005816932A

United States Patent [19]

Alexander

[11] Patent Number: 5,816,932

[45] Date of Patent: Oct. 6, 1998

[54] GOLF SWING TRAINING DEVICE

[76] Inventor: John S. Alexander, 1825 S. College, Springfield, Ill. 62704

[21] Appl. No.: 922,585

[22] Filed: Sep. 3, 1997

[51] Int. Cl.[6] ..... A63B 69/36

[52] U.S. Cl. ..... 473/259

[58] Field of Search ..... 473/257, 258, 473/259, 260

[56] References Cited

U.S. PATENT DOCUMENTS

| | | | |
|---|---|---|---|
| 2,653,025 | 9/1953 | Zega | 273/35 |
| 3,339,927 | 9/1967 | Nunn | 273/191 |
| 3,341,208 | 9/1967 | Marcella | 273/191 |
| 3,583,707 | 6/1971 | Fujimoto | 273/191 A |
| 4,071,251 | 1/1978 | Beckish | 273/186 R |
| 4,852,881 | 8/1989 | Bellagamba et al. | 273/183 B |
| 4,949,974 | 8/1990 | Bellagamba | 273/186 R |
| 5,330,192 | 7/1994 | Amos | 473/259 |
| 5,423,548 | 6/1995 | Bricker | 273/191 A |
| 5,439,225 | 8/1995 | Gvoich et al. | 273/186.1 |
| 5,441,275 | 8/1995 | Yoshishita | 273/191 A |

*Primary Examiner*—George J. Marlo

*Attorney, Agent, or Firm*—Senniger, Powers, Leavitt & Roedel

[57] ABSTRACT

A golf swing training device comprises a swing guide, a base structure adapted to lie on a generally horizontal surface and a framework on the base structure for supporting the swing guide in position above the base structure in a plane at a selected angle to the horizontal surface. The swing guide has a lower portion in front of the golfer at a relatively low elevation with respect to the surface and an upper portion in back of the golfer at a relatively high elevation with respect to the surface. The framework comprises a forward ring member support on the base structure supporting the lower portion of the swing guide and permitting variation of the angle of the plane of the swing guide, and a rearward articulated prop for propping up the upper portion of the swing guide. The rearward articulated prop is pivoted at one end thereof constituting its lower end on the base structure for angular adjustment about a generally horizontal axis extending transversely with respect to the base structure generally adjacent the surface and pivotally connected at the other end thereof constituting its upper end to the upper portion of the swing guide. Articulation of the prop enables adjustment of the elevation of the upper portion of the swing guide and the angle of the plane of the swing guide.

15 Claims, 7 Drawing Sheets

GOLF SWING TRAINING DEVICE

BACKGROUND OF THE INVENTION

The present invention relates generally to golf training devices, and more particularly to golf training devices for training the swing motion of a golf club.

Numerous factors are involved in properly striking a golf ball. For example, proper gripping of the golf club, proper body alignment, proper addressing of the ball and proper swing motion must be combined for correct execution of a golf shot. Of these, the club grip, body alignment and addressing of the ball are established before the swing motion, while the golfer is stationary, and are easily visualized by a golfer or instructor so that correction can be made where necessary. The golfer's swing motion, however, is substantially more difficult to visualize and correct.

A proper golf swing motion is typically learned through repetition so that the golf swing becomes a naturally reflexive or habitual motion. To this end, numerous teaching devices have been devised to facilitate education and instruction of a golfer for developing a habitually proper golf swing. These devices generally include a frame and an arcuate or hoop shaped swing guide supported by the frame that defines the proper swing path of the golf club. The golfer stands adjacent the swing guide, with the club in contact with the guide, and swings the club along the swing guide throughout the backswing, downswing and follow-through of the swing. Through repetitive swinging of the golf club along the proper swing path defined by the swing guide, the proper motion becomes naturally reflexive or habitual to the golfer.

These golf training devices are often of complex construction and can be difficult to erect. They also do not adequately adjust to the height and positioning of the particular individual golfer, or their adjustment is complex. In addition, these devices are large and require a large amount of space for storage unless the golfer expends effort disassembling the device, only to reassemble the device the next time it is to be used.

SUMMARY OF THE INVENTION

Among the several objects of this invention may be noted the provision of an improved golf swing training device which facilitates training a golfer to develop a proper swing motion; the provision of such a training device which is easy to assemble and erect; the provision of such a training device that can be readily adjusted according to the height and positioning of each golfer using the device; the provision of such a training device which reduces the risk of damage to the shaft of a golf club; the provision of such a training device which is collapsible for storage and transport without disassembly; and the provision of such a training device which is less costly to manufacture.

A golf swing training device of this invention generally comprises a swing guide comprising a generally ring-shaped member and means for supporting the member in position to guide the swinging of a golf club by a golfer standing in position generally within the ring with the club sliding on the ring for guiding the club for efficient stroking thereof throughout the backswing, downswing and follow-through. The supporting means comprises a base structure adapted to lie on a generally horizontal surface and a framework on the base structure for supporting the ring member in position above the base structure in a plane at a selected angle to the horizontal surface. The ring member has a lower portion in front of the golfer at a relatively low elevation with respect to the surface and an upper portion in back of the golfer at a relatively high elevation with respect to the surface. The framework comprises forward ring member support means on the base structure supporting the lower portion of the ring member and permitting variation of the angle of the plane of the ring member. Rearward articulated prop means are included for propping up the upper portion of the ring member. The rearward articulated prop means is pivoted at one end thereof constituting its lower end on the base structure for angular adjustment about a generally horizontal axis extending transversely with respect to the base structure generally adjacent the surface and pivotally connected at the other end thereof constituting its upper end to the upper portion of the ring member. Articulation of the prop means enables adjustment of the elevation of the upper portion of the ring member and the angle of the plane of the ring member.

In another embodiment similar to that described above, the forward ring member support means of the golf swing training device of this invention has a lower end pivotally connected to the base structure for pivoting movement about a generally horizontal axis extending transversely with respect to the base structure generally adjacent the horizontal surface. An upper end of the forward ring member support means is connected to the lower portion of the ring member. Pivoting movement of the forward ring member support means with respect to the horizontal surface enables adjustment of the elevation and angle of the ring member. The forward ring member support means and the rearward articulated prop means are constructed and arranged such that the training device is capable of being collapsed into a generally flat configuration for storage and transport of the device. The ring member is capable of remaining connected to the framework during collapsing of the device.

In yet another embodiment similar to that described above, height indicating means is provided on the framework for setting the elevation of the ring member to correspond with a predetermined height setting based on the height of the golfer. Angle indicating means is associated with the framework for setting the angle of the plane of the ring member to correspond with a predetermined angle setting based on the club being swung by the golfer.

Other objects and features will be in part apparent and in part pointed out hereinafter.

BRIEF DESCRIPTION OF THE DRAWINGS

Corresponding parts are indicated by corresponding reference numerals throughout the several views of the drawings.

DESCRIPTION OF THE PREFERRED EMBODIMENTS

Figure 1:
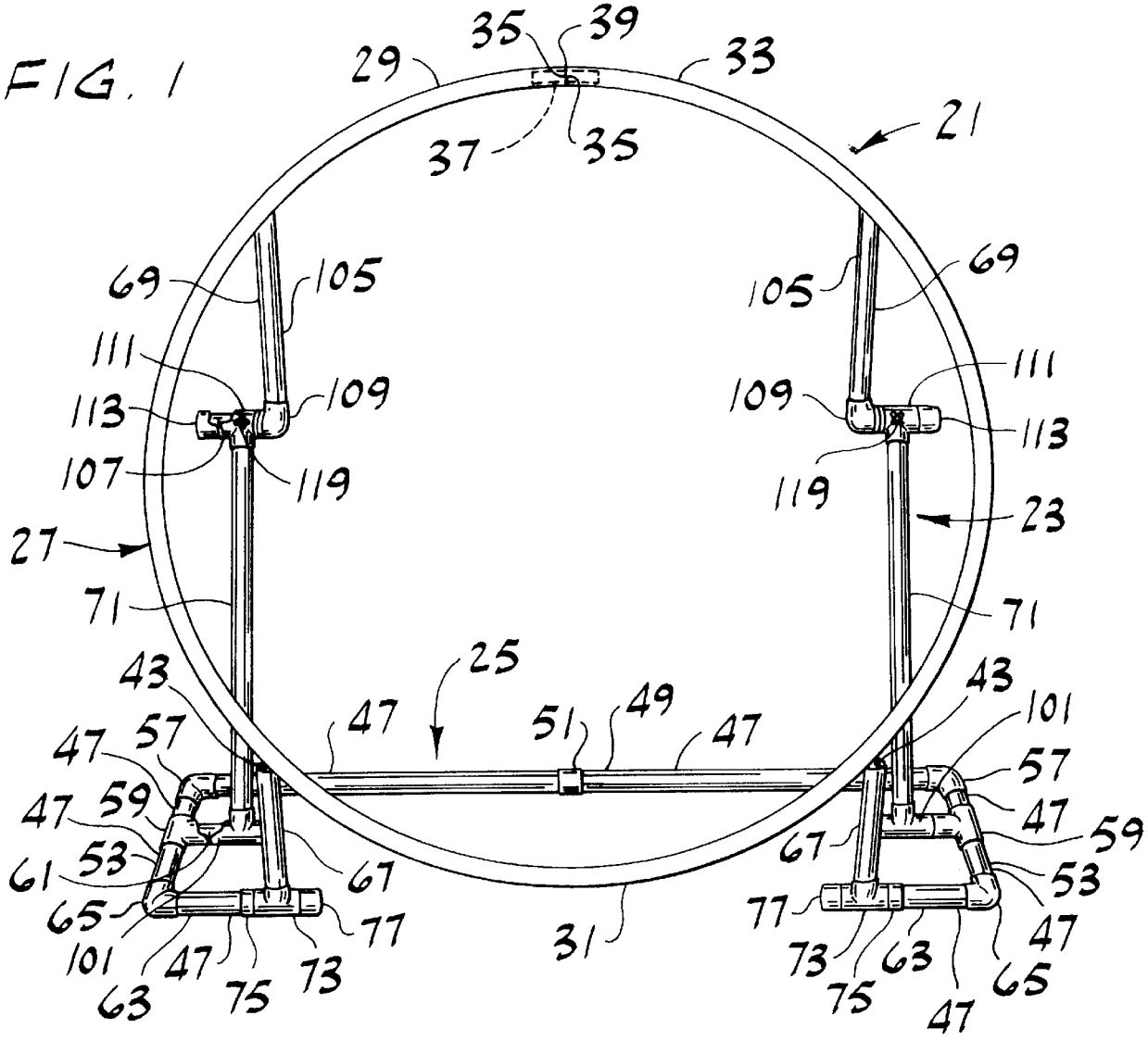
FIG. 1 is front perspective of a golf swing training device of the present invention.
Figure 2:
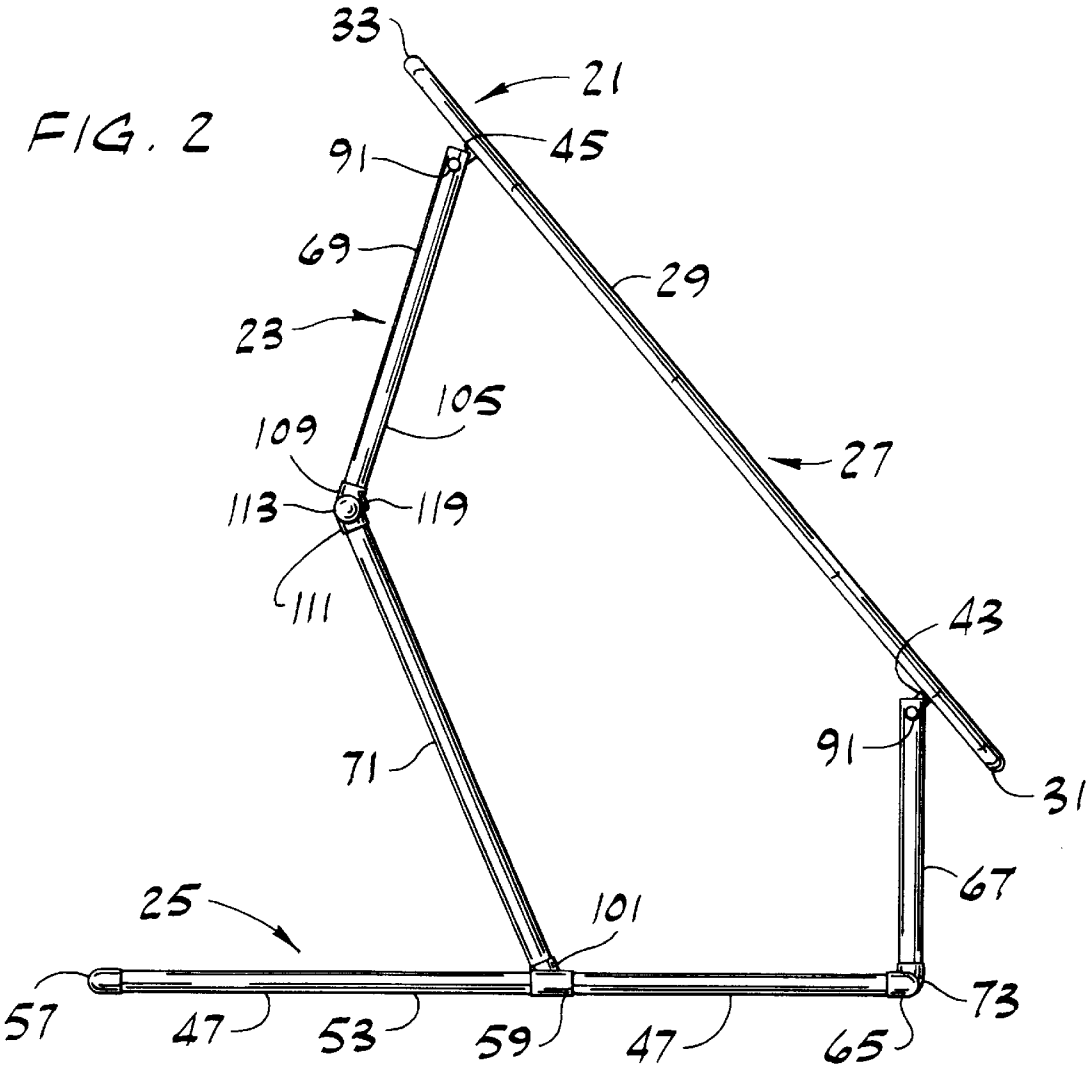
FIG. 2 is a side view thereof showing a swing guide at a first angle and elevation with respect to the ground.
Figure 3:
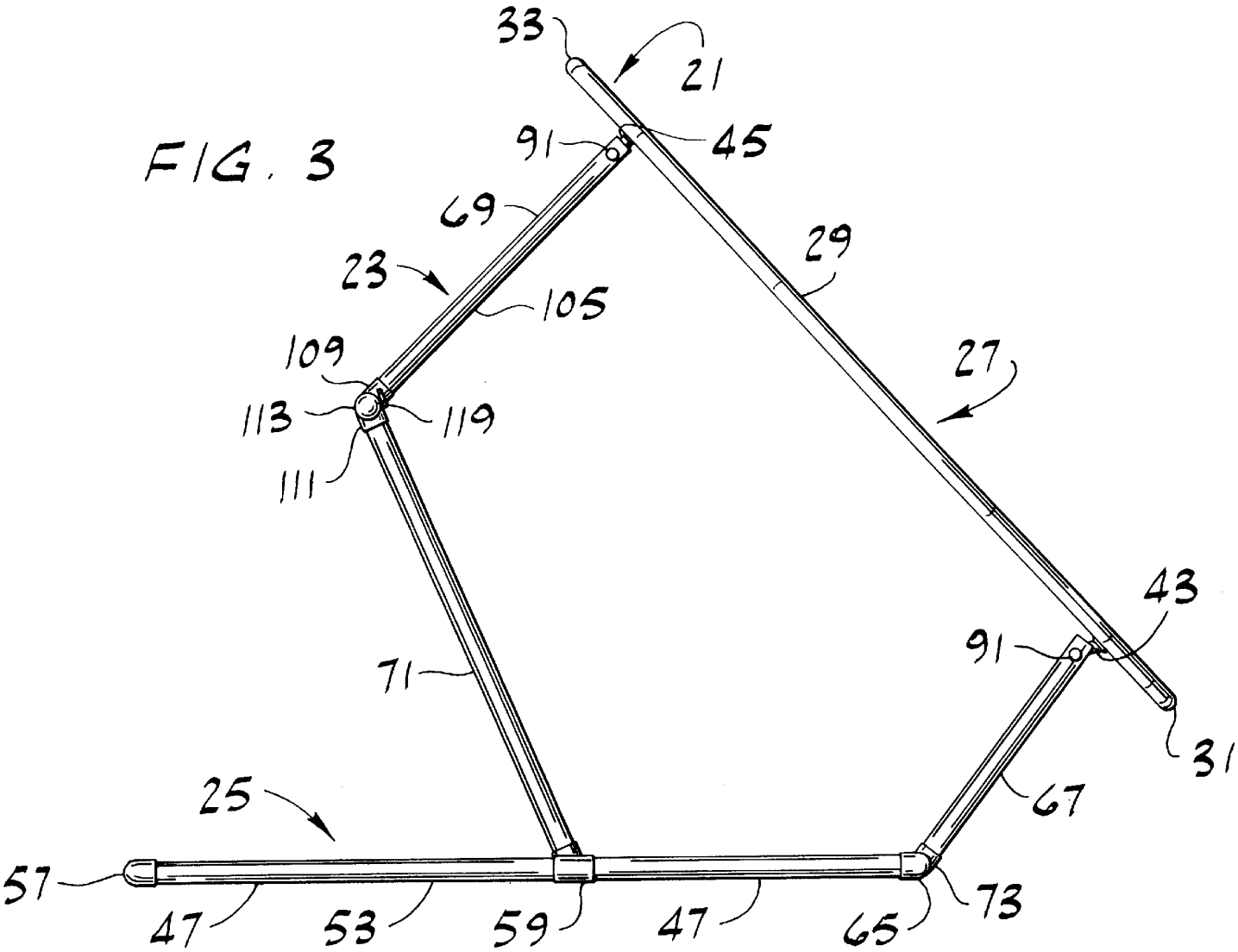
FIG. 3 is a side view similar to FIG. 2 showing the swing guide at a second angle and elevation with respect to the ground.
Figure 7:
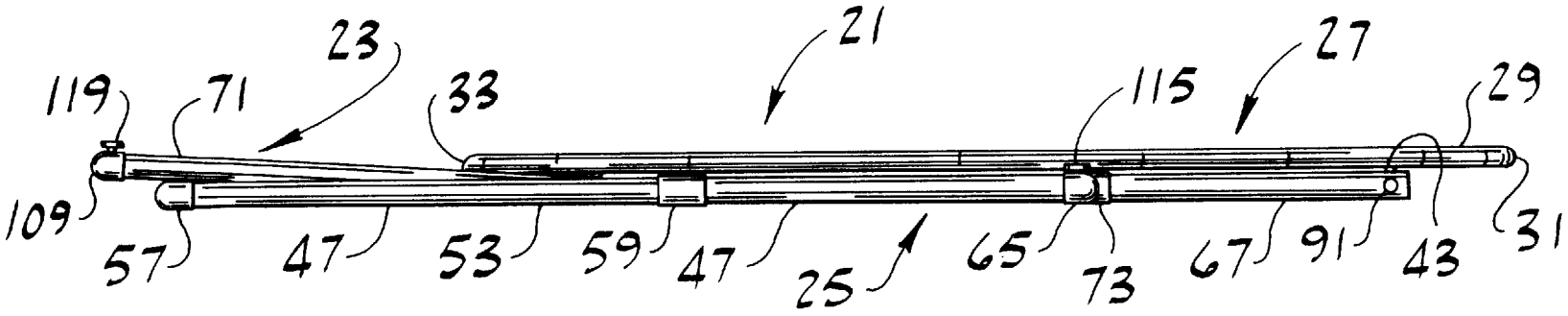
FIG. 7 is a side view of the golf swing training device of FIG. 1 in a collapsed configuration.

Now referring to the drawings, and more particularly to FIG. 1, a golf swing training device of the present invention is generally indicated at 21. Adjustable framework, generally indicated at 23, is mounted on a base structure, generally indicated at 25 for adjustably supporting a golf swing guide, generally indicated at 27 (the base structure and framework constituting "supporting means" for the swing guide), in position to guide the swinging of a golf club by a golfer for efficient stroking throughout the backswing, downswing and follow-through. The device 21 is operable between a raised configuration, as illustrated in FIGS. 1–3, for use by the golfer and a collapsed configuration, as illustrated in FIG. 7, for transporting and storing the device when it is not in use.

Figure 4:
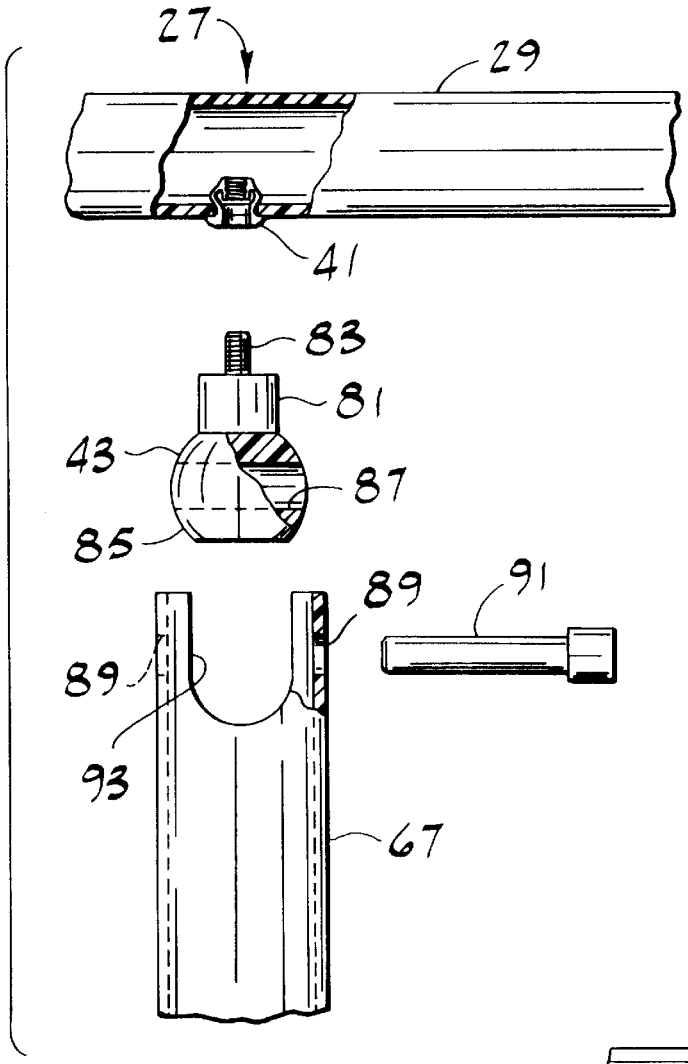
FIG. 4 is an exploded view of a coupling used for connecting the swing guide to a framework of the device.
Figure 5:
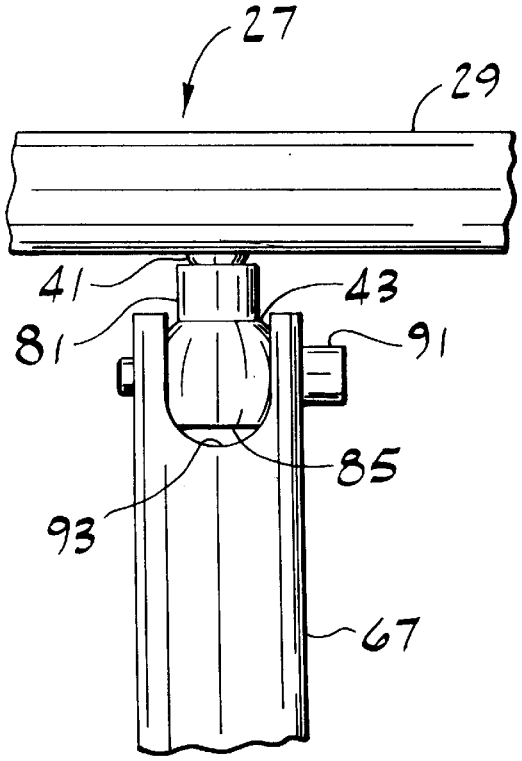
FIG. 5 is an assembled view of the coupling of FIG. 4.

The swing guide 27 comprises a generally ring-shaped member 29 having a lower portion 31 supported by the framework 23 at a relatively low elevation above the ground, and an upper portion 33 supported by the framework at a relatively higher elevation above the ground so that the plane of the swing guide is angled relative to the ground. The swing guide 27 is preferably of unitary construction formed of an elongate, polyethylene tube having opposing open ends 35. The elongate tube is sufficiently flexible to permit bending of the tube into the ring shape of the member 29. A connector 37 fits tightly into the opposing ends 35 to connect the ends for holding the continuous, circular shape of the ring-shaped member 29 of the swing guide 27. The swing guide 27 thus has only a single seam 39 (e.g. at the junction of the opposing ends 35). The seam 39 is preferably centrally positioned on the upper portion 33 of the swing guide 27 so that the club shaft does not slide across the seam while moving along the swing path of the club. This aspect of the invention represents an improvement over training devices having two or more seams, or having a seam (or seams) at a location where it contacts the shaft of the club, because it reduces wear on the shaft and reduces the risk of damage to the club shaft, particularly shafts constructed of graphite or other composite materials. Internally threaded inserts 41 (see particularly FIG. 4) are secured in the swing guide 27 for receiving couplings (only one set of which is shown and indicated at 43 in FIG. 1) that pivotally connect the swing guide to the framework 23.

It is to be understood that the ring-shaped member 29 of the swing guide 27 may be other than a complete circle and continuous without departing from the scope of this invention. For example, the ring-shaped member 29 may be semi-circular or otherwise arcuate and discontinuous, in which the opposing ends 35 are spaced apart and connected to the framework 23, or the member may be semi-circular or otherwise partially circular and have a substantially straight cross-bar (not shown) extending between the opposing ends so that the member is still generally continuous.

The base structure 25 is assembled from tubes 47 constructed of a PVC material. The tubes 47 are connected to define a generally U-shaped structure capable of lying flat on the ground or other horizontal surface in a generally horizontal plane. For example, the base structure 35 of the illustrated embodiment includes a rear base member 49 having a pair of tubes 47 connected by a straight connector 51. Side base members 53 extend forward from the rear base member 49 in parallel, spaced-apart relationship and are connected to the rear base member by elbow connectors 57. Each side base member 53 is constructed of two tubes 47 connected by a T-connector 59. Rear pivot extensions 61 are defined by additional tubes connected to the T-connectors 59 and extending transversely inward of the side base members 53 parallel to the rear base member 49. Forward pivot extensions 63 are defined by tubes 47 connected to the forward ends of the side base members 53 by elbow connectors 65 and extending transversely inward of the side base members in generally parallel relationship with the rear pivot extensions 61.

The framework 23 mounted on the base structure 25 comprises forward support members 67 (broadly, "forward ring-member support means") for supporting the lower portion 31 of the swing guide 27 and upper and lower rearward support members 69, 71, respectively (the upper and lower rearward support members broadly defining "rearward articulated prop means"), for supporting the upper portion 33 of the swing guide. The forward support members 67 are pivotally connected to the forward pivot extensions 63 by suitable T-connectors 73. A portion of each T-connector 73 functions as a sleeve that fits loosely over the respective forward pivot extension 63 to permit pivoting movement of the T-connector and respective forward support member 67 about a longitudinal rotation axis of the forward pivot extension. The T-connectors 73 abut against collars 75 fixedly attached around the extensions 63. Caps 77 are secured over the inner ends of the forward pivot extensions 63 to retain the T-connectors 73 between the collars 75 and caps against translating movement.

The lower portion 31 of the swing guide 27 is pivotally connected to the upper ends of the forward support members 67 by the couplings 43, each comprising a generally cylindrical post 81 having an externally threaded fastener 83 extending longitudinally outward therefrom and sized for threadably engaging the internal threading of the insert 41 in the swing guide to secure the coupling to the swing guide. The coupling 43 has a ball-shaped end 85 connected to the post 81 opposite the fastener 83, the ball having a bore 87 extending therethrough in transverse relationship with respect to the post and fastener.

The forward support members 67 are open at their upper ends for receiving the ball-shaped ends 85 of the couplings 43 and have opposing openings 89 positioned for alignment with the bores 87 of the ball-shaped ends of the couplings when the ball-shaped ends are received in the forward support members. Pins 91 are sized for insertion through the openings 89 in the forward support members 67 and the ball-shaped ends 85 of the couplings 43 to connect the lower portion 31 of the swing guide 27 to the forward support members for conjoint pivoting movement about the forward pivot extensions 63. However, the pins 91 are sufficiently smaller in diameter than the bores 87 of the couplings 43 to permit pivoting movement of the ball-shaped ends 85 (and hence the lower portion 31 of the swing guide 27) about the rotation axis of the pins relative to the upper ends of the forward support members 67 to facilitate the angle change of the swing guide with respect to the ground as the forward support members are pivoted about the forward pivot extensions 63. The upper ends of the forward support members 67 have notches 93 to provide sufficient clearance for the posts 81 of the couplings 43 as the couplings pivot about the pins 91 relative to the support members.

The lower rearward support members 71 of the rearward articulated prop means are pivotally connected to the rear pivot extensions 61 of the base structure 25 by suitable T-connectors 101. A portion of each T-connector 101 functions as a sleeve that fits loosely over the respective rear pivot extension 61 to permit pivoting movement of the T-connector about a longitudinal rotation axis of the pivot extension. The T-connectors 101 each abut against the respective T-connector 59 that joins each rear pivot extension 61 to the respective side base member 53 of the base structure 25. Caps (not shown) are secured over the inner ends of the pivot extensions 61 abutting against the T-connectors 101 to secure the T-connectors against translating movement. The lower rearward support members 71 are connected to the T-connectors 101 for conjoint pivoting movement about the rear pivot extensions 61.

Figure 8:
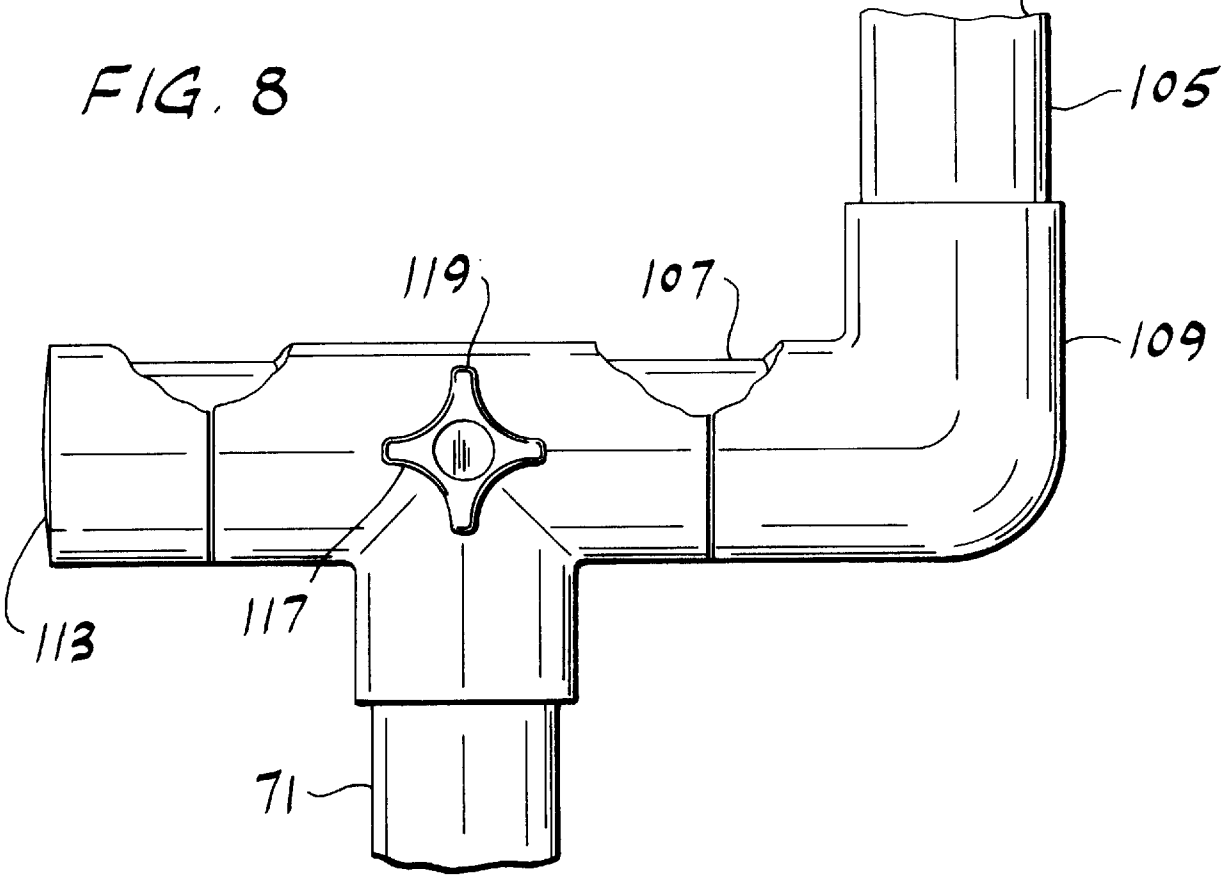
FIG. 8 is the fragmentary front view of FIG. 6B without the indicia and with portions removed to reveal internal construction.

The upper rearward support members 69 of the prop means are generally L-shaped, each comprising an upward extending member 105 and a generally horizontal member 107 (FIG. 8) defining the lower end of the upper rearward support member. Each horizontal member 107 is connected to the respective upward extending member 105 by an elbow connector 109 and extends outward in generally parallel relationship with the respective rear pivot extension 61. The horizontal members 107 of the upper rearward support members 69 are connected to the upper ends of the lower rearward support members 71 by T-connectors 111. A portion of each T-connector 111 functions as a sleeve that fits loosely over the respective horizontal member 107 of the upper rearward support member 69 to permit pivoting movement of the T-connector about a longitudinal rotation axis of the horizontal member so that the upper rearward support member is capable of pivoting movement relative to the lower rearward support member 71. The T-connectors 111 each abut against the respective elbow connector 109 joining the upward extending member 105 and horizontal member 107 of the upper rearward support member 69, and caps 113 are secured over the outer ends of the horizontal members in abutting relationship with the T-connectors to secure the T-connectors against translating movement. It is to be understood that each upper rearward support member 69 may be of unitary construction, or the horizontal members 107 may be connected to the upper ends of the lower rearward support members 71, without departing from the scope of this invention.

The upper portion 33 of the swing guide 27 is connected to the upper ends of the upper rearward support members 69 by a rear set of couplings 45 (FIGS. 2 and 3) such that pivoting movement of the upper and lower rearward support members 69, 71 (e.g. articulation of the articulated prop means) causes adjustment of the angle of the swing guide 27 and adjustment of the elevation of the upper portion 33 of the swing guide relative to the ground. The articulating motion of the articulated prop means represents an improvement over training devices that utilize telescoping members because it allows for a adjustment of the swing guide 27 to a broader range of elevations and swing guide angles, including the ability to fully collapse the training device 21 to a generally flat configuration as illustrated in FIG. 7, without removing the swing guide from the framework 23. In the illustrated embodiment, the rear set of couplings connecting the upper portion 33 of the swing guide 27 to the upper ends of the upper rearward support members 69 are substantially identical to the couplings 43 connecting the lower portion 31 of the swing guide to the forward support members 67 and function in a similar manner.

Figure 6A:
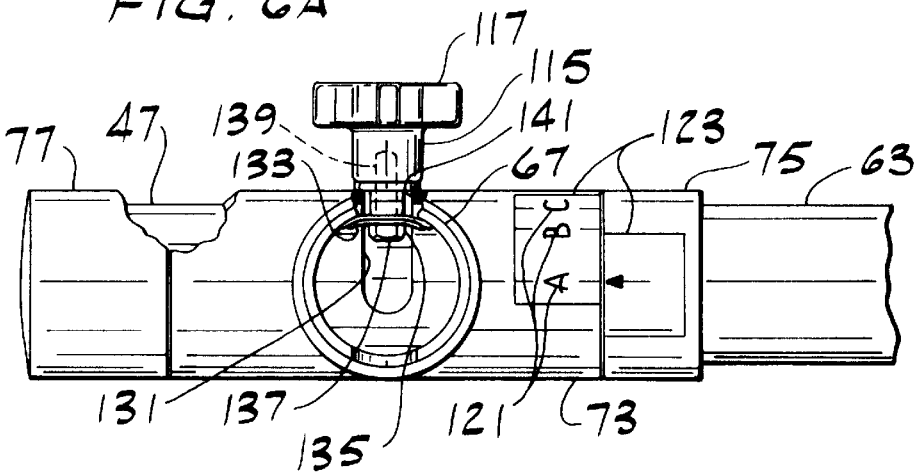
FIG. 6A is a fragmentary top view of a portion of the training device showing a friction lock and indicia for setting the elevation of a lower portion of the swing guide with respect to the ground, with portions removed to reveal internal construction.
Figure 6B:
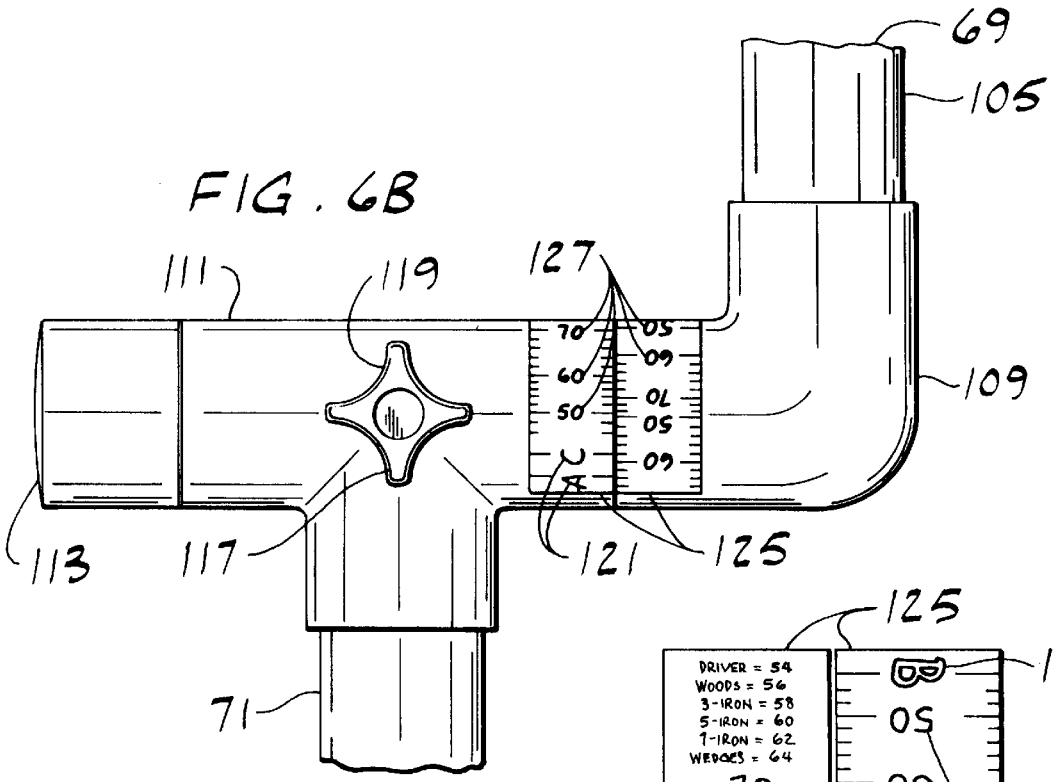
FIG. 6B is a fragmentary front view of another portion of the training device showing a friction lock and indicia for setting the elevation and angle of an upper portion of the swing guide with respect to the ground.

As seen best in FIGS. 6A and 6B, friction locks 115 releasably secure the forward support members 67 against pivoting movement relative to the forward pivot extensions 63. Each forward pivot extension 63 has an arcuate slot 131 (FIG. 6A) along a portion of its circumference, the ends of which define the limits of the pivoting movement of the forward support member 67. Each friction lock 115 comprises a washer 133 disposed in the respective forward pivot extension 63, and a bolt 135 having a head 137 sized larger than the washer opening and a threaded stem 139 extending outward from the head. The threaded stem 139 extends through the washer 133, the arcuate slot 131 in the pivot extension 63, and an opening 141 in the T-connector 73 to which the forward support member 67 is connected. A knob 117 having an internally threaded opening (not shown) is threaded onto the stem 139 of the bolt 135 so that turning of the knob pulls the head 237 of the bolt toward the knob to draw the washer 133 against the pivot extension 63 and to draw the knob against the T-connector 73. Increased turning of the knob 117 tightly clamps the forward pivot extension 63 and the T-connector 73 together in friction contact so that the T-connector can no longer pivot about the forward pivot extension. Turning the knob 117 in the opposite direction decreases the friction contact between the T-connector 73 and the forward pivot extension 63 to permit pivoting movement. Similar friction locks 119 releasably secure the upper rearward support members 69 against pivoting movement relative to the lower rearward support members 71. Locking devices other than friction devices, such as locking pins or screw fasteners, may also be used without departing from the scope of this invention.

Figure 6C:
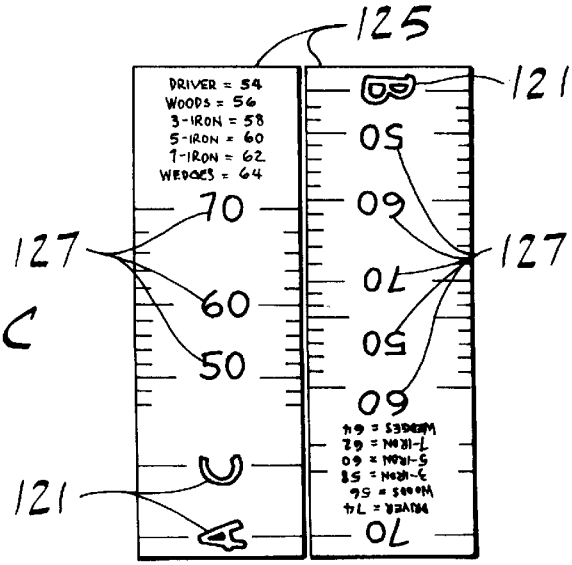
FIG. 6C is a plan view of the indicia of FIG. 6B laid flat.

With further reference to FIGS. 6A, 6B, and 6C, proper adjustment of the elevation of the swing guide 27 and the angle of the swing guide plane is facilitated by indicia on the training device. Height adjusting indicia 121 (broadly "height indicating means") comprise lettering (e.g. "A", "B", "C") wherein each letter corresponds to a predetermined, recommended elevation of the swing guide 27 above the ground based on the height of the golfer using the training device. For example, in the illustrated embodiment, the height adjusting indicia 121 includes a first set of labels 123 (FIG. 6A) associated with the adjustment of the elevation of the lower portion 31 of the swing guide 27 and a second set of labels 125 (FIG. 6B) associated with the adjustment of the elevation of the upper portion 33 of the swing guide. The first set of labels 123 includes a label on each of the pivotable T-connectors 73 connecting the forward support members 67 to the forward pivot extensions 63 having the letters "A", "B", and "C", and a corresponding label on each of the collars 75 having an indicator, such as an arrow or other suitable notation. Registration of the letter with the arrow indicates that the lower portion 31 of the swing guide 27 is at the predetermined, recommended elevation.

The second set of labels 125 includes a label on each of the pivotable T-connectors 111 connecting the upper and lower rearward support members 69, 71 having the letters "A" and "C" and a corresponding label on each of the elbow connectors 109 against which the T-connectors 111 abut having the letter "B" (FIG. 6C) . The letters on this second set of labels 125 are preferably color coded (e.g. the "A" is black, the "B" is blue and the "C" is red) for reasons which will become apparent, and correspond directly with the lettering on the first set of labels 123.

Angle adjusting indicia 127 (broadly, "angle indicating means") comprises numbering corresponding to a predetermined, recommended angle of the swing guide relative to the ground based on the golf club being used by the golfer. In the illustrated embodiment, three sets of angle numbering, each covering a range of angles from 46–70 degrees, appear on the second set of labels 125 along with the lettering used for adjusting the elevation of the upper portion 33 of the swing guide 27. The numbering is color coded in accordance with the color coding of the lettering wherein a particular colored set of numbering appears on the label opposite the label having the same colored letter. For example, a red set of angle numbering and a black set of angle numbering appears on the label having the blue "B" and a blue set of angle numbering appears on the label having the black "A" and red "C." Use of the letter corresponding to the letter used for the first set of labels 123 assures proper elevation of the upper portion 33 of the swing guide 27, and registration of the letter with the desired angle of the same color indicates that the angle of the swing guide plane is properly adjusted.

In operation, the golfer determines a recommended elevation setting (e.g. "A", "B", or "C") based on the golfer's height and a recommended angle setting for the swing guide plane based on the golf club being used by the golfer. The knobs 117 of the friction locks 115 associated with the forward support members 67 are turned so as to decrease the frictional contact between the T-connectors 73 and the forward pivot extensions 63. The forward support members 67 are pivoted about the rotation axis of the forward pivot extensions 63 until the designated letter of the height adjusting indicia 121 on the first set of labels 123 (e.g. the designated letter) is properly registered so that the lower portion 31 of the swing guide 27 is adjusted to the predetermined elevation above the ground. As the lower portion 31 of the swing guide 27 is raised or lowered with the pivoting of the forward support members 67, the ball-shaped ends 85 of the couplings 43 connecting the lower portion of the swing guide to the upper ends of the forward support members 67 pivot about the rotation axis of the pins 91 to facilitate proper adjustment of the elevation of the lower portion of the swing guide. The knobs 117 of the friction locks 115 are then turned to increase the frictional contact between the T-connectors 73 and the forward pivot extensions 63 to secure the forward support members 67 and lower portion 31 of the swing guide 27 at the desired position.

The golfer determines the recommended angle setting for the swing guide plane and also notes the color of letter on the second set labels 125 corresponding to the letter of the first set of labels 123 used for setting the elevation of the lower portion 31 of the swing guide 27. For example, if height setting "B" of the first set of labels 123 was used in adjusting the elevation of the lower portion 31 of the swing guide 27, then the blue "B" on the second set of labels (FIG. 6C) and the corresponding blue set of angle markings are used in adjusting the elevation of the upper portion 33 of the swing guide and the angle of the swing guide plane. If a driver is to be used by the golfer, then the 54 degree angle marking (in the set of blue angle markings) is used.

The knobs 117 of the friction locks 119 associated with the upper rearward support members 69 are then turned so as to decrease the frictional contact between the T-connectors 111 and the horizontal members 107 of the upper rearward support members. The upper rearward support members 69 are then pivoted with respect to the lower rearward support members 71 until the appropriate angle marking (i.e. the blue 54 degree marking) is in registry with the appropriate height setting marking (i.e. the blue "B"). As the upper rearward support members 69 pivot with respect to the lower rearward support members 71, the lower rearward support members pivot freely about the rear pivot extensions 61. The ball-shaped ends 85 of the rear set of couplings connecting the upper portion 33 of the swing guide 27 to the upper rearward support members 69 pivot about the pins to facilitate proper adjustment of the elevation of the upper portion of the swing guide and the angle of the swing guide plane. The knobs 117 of the friction locks 119 are then turned so as to increase the frictional contact between the T-connectors 111 the upper rearward support members 69 to secure the upper and lower rearward support members and the upper portion 33 of the swing guide 27 at the desired position.

The golfer then stands generally within the swing guide 27, facing toward the lower portion 31 of the swing guide. The golfer grips the club and lets the head of the club rest on the ground, with the shaft of the club lying in contact with the lower portion 31 of the swing guide 27. The golfer then swings the club through the backswing, downswing and follow-through, maintaining the shaft in contact with the swing guide 27 so that the swing guide guides the club through the proper swing path. Repetition of this exercise helps to "groove" the swing so that the proper swing path is naturally repeated without the swing guide.

With reference to FIG. 7, to collapse the training device 21 for transport and storage, the knobs 117 of the friction locks 115, 119 are turned to decrease the friction between the between the T-connectors 73 and the forward pivot extensions 63 and between the T-connectors 111 and the lower ends of the upper rearward support members 69. The swing guide 27 is then pushed downward so that the forward support members 67 pivot forward relative to the forward pivot extension 63 until the forward support members lie generally flat on the ground. The lower rearward support members 71 pivot backward relative to the rearward pivot extensions 61 and the upper rearward support members 69 pivot forward relative to the lower rearward support members until the lower rearward support members contact the rear base member 49 and the swing guide 27 lies generally horizontal with respect to the ground. The training device 21 is thus in a collapsed, generally horizontal configuration which is easily transported and stored.

While the golf swing training device 21 of the present invention is shown and described herein as being generally symmetrical, it is to be understood that the forward support members 67 are adjustable independent of each other, as are the upper and lower rearward support members 69, 71, so that one side of the swing guide 27 may be adjusted differently from the other side of the swing guide without departing from the scope of this invention.

It will be observed from the foregoing that the golf swing training device 21 shown and described herein satisfies the several various objectives of the invention and provides other advantageous results. Providing forward support members 67 that are pivotable with respect to the ground, along with upper and lower rearward support members 69, 71 that are also pivotable with respect to the ground, permits the device to be collapsed to a generally flat configuration without removing the swing guide 27 from the framework or disassembling any portion of the device 21. As such, once the device 21 is initially assembled, there is no need to disassemble and reassemble the device each time it is stored and then reused. The flat, collapsed configuration also provides a low profile so that the device 21 is easily transported and takes up only a narrow amount of space for efficient storage of the device.

The adjustable framework 23 allows both the angle of the swing guide 27 and the elevation of the swing guide to be adjusted to numerous positions depending on the height of the golfer and the club being used by the golfer. However, only six support members 67, 69, 71 are used to support the swing guide 27, with the base structure 25 providing substantial support for the framework 23 to insure stability of the device 23, thereby reducing the cost of manufacturing the training device. In addition, the height adjusting and angle adjusting indicia 121, 127 provide the golfer with positive visual identification of the elevation and angle of the swing guide 27, as well as an easy method for determining the proper elevation and angle of the swing guide.

As various changes could be made in the above constructions without departing from the scope of the invention, it is intended that all matter contained in the above description or shown in the accompanying drawings shall be interpreted as illustrative and not in a limiting sense.

What is claimed is:

1. A golf swing training device comprising:

a swing guide comprising a generally ring-shaped member and means for supporting said member in position to guide the swinging of a golf club by a golfer standing in position generally within the ring with the club sliding on the ring for guiding the club for efficient stroking thereof throughout the backswing, downswing and follow-through, said supporting means comprising a base structure adapted to lie on a generally horizontal surface and a framework on the base structure for supporting said ring member in position above the base structure in a plane at a selected angle to the horizontal surface with the ring member having a lower portion in front of the golfer at a relatively low elevation with respect to said surface and an upper portion in back of the golfer at a relatively high elevation with respect to said surface, said framework comprising forward ring member support means on the base structure supporting said lower portion of the ring member and permitting variation of the angle of the plane of said ring member, and rearward articulated prop means for propping up said upper portion of the ring member, said rearward articulated prop means being pivoted at one end thereof constituting its lower end on the base structure for angular adjustment about a generally horizontal axis extending transversely with respect to the base structure generally adjacent said surface and pivotally connected at the other end thereof constituting its upper end to said upper portion of the ring member, articulation of the said prop means enabling adjustment of the elevation of said upper portion of the ring member and the angle of the plane of the ring member.

2. A golf swing training device as set forth in claim 1 wherein the lower portion of the ring member is pivotally connected to said forward ring member support means at an upper end of said support means to facilitate adjustment of the elevation and angle of the swing guide.

3. A golf swing training device as set forth in claim 2 further comprising a coupling attached to the forward portion of the ring member and having a bore therethrough, the forward ring member support means being adapted for receiving the coupling therein and having opposing openings positioned for alignment with the bore of the coupling when the coupling is received in the support means; and a pin sized for insertion through the openings in the support means and the bore in the coupling to releasably connect the lower portion of the ring member to the forward ring member support means, the coupling being pivotable about a central longitudinal axis of the pin to permit pivoting movement of the ring member with respect to the forward ring member support means.

4. A golf swing training device as set forth in claim 3 wherein the forward ring member support means is notched to facilitate pivoting movement of the ring member with respect to the support means.

5. A golf swing training device as set forth in claim 3 wherein the upper portion of the ring member is pivotally connected to the rearward articulated prop means by a coupling substantially similar to the coupling connecting the lower portion of the ring member to the forward ring member support means.

6. A golf swing training device as set forth in claim 1 wherein the forward ring member support means has a lower end pivotally connected to the base structure for pivoting movement about a generally horizontal axis extending transversely with respect to the base structure generally adjacent said horizontal surface and an upper end connected to the lower portion of the ring member, pivoting movement of the forward ring member support means with respect to the horizontal surface enabling adjustment of the elevation and angle of the ring member.

7. A golf swing training device as set forth in claim 6 wherein the forward ring member support means and the rearward articulated prop means are constructed and arranged such that the training device is capable of being collapsed into a generally flat configuration for storage and transport of the device, the ring member being capable of remaining connected to the framework during collapsing of the device and when fully collapsed.

8. A golf swing training device as set forth in claim 1 further comprising height indicating means on the framework for setting the elevation of the ring member to correspond with a predetermined height setting based on the height of the golfer.

9. A golf swing training device as set forth in claim 8 further comprising angle indicating means associated with the framework for properly setting the angle of the plane of the ring member to correspond with a predetermined angle setting based on the club being swung by the golfer.

10. A golf swing training device as set forth in claim 9 wherein the height indicating means comprises a first set of labels on the forward ring member support means to facilitate positioning of the support means for supporting the lower portion of the ring member at an elevation according to the predetermined height setting, and a second set of labels on the rearward articulated prop means to facilitate articulation of the prop means to a position at which the upper portion of the ring member is supported at an elevation according to the predetermined height setting, said second set of labels also defining said angle indicating means to facilitate articulation of the prop means to a position at which the ring member is supported at an angle with respect to the horizontal surface corresponding to the predetermined angle setting.

11. A golf swing training device as set forth in claim 10 wherein the angle indicating means is a function of the height indicating means.

12. A golf swing training device as set forth in claim 1 wherein the ring member is of unitary construction, the ring member being free of any joints along the swing path of the golf club.

13. A golf swing training device as set forth in claim 12 wherein the ring member is generally continuous.

14. A golf swing training device comprising:

a swing guide comprising a generally ring-shaped member and means for supporting said member in position to guide the swinging of a golf club by a golfer standing in position generally within the ring with the club sliding on the ring for guiding the club for efficient stroking thereof throughout the backswing, downswing and follow-through, said supporting means comprising a base structure adapted to lie on a generally horizontal surface and a framework on the base structure for supporting said ring member in position above the base structure in a plane at a selected angle to the horizontal surface with the ring member having a lower portion in front of the golfer at a relatively low elevation with respect to said surface and an upper portion in back of the golfer at a relatively high elevation with respect to said surface, said framework comprising forward ring member support means on the base structure supporting said lower portion of the ring member and permitting variation of the angle of the plane of said ring member, and rearward articulated prop means for propping up said upper portion of the ring member, said rearward articulated prop means being pivoted at one end thereof constituting its lower end on the base structure for angular adjustment about a generally horizontal axis extending transversely with respect to the base structure generally adjacent said surface and pivotally connected at the other end thereof constituting its upper end to said upper portion of the ring member, articulation of the said prop means enabling adjustment of the elevation of said upper portion of the ring member and the angle of the plane of the ring member, said forward ring member support means having a lower end pivotally connected to the base structure for pivoting movement about a generally horizontal axis extending transversely with respect to the base structure generally adjacent said horizontal surface and an upper end connected to the lower portion of the ring member, pivoting movement of the forward ring member support means with respect to the horizontal surface enabling adjustment of the elevation and angle of the ring member, the forward ring member support means and the rearward articulated prop means being constructed and arranged such that the training device is capable of being collapsed into a generally flat configuration for storage and transport of the device, the ring member being capable of remaining connected to the framework during collapsing of the device.

15. A golf swing training device comprising:

a swing guide comprising a generally ring-shaped member, means for supporting said member in position to guide the swinging of a golf club by a golfer standing in position generally within the ring with the club sliding on the ring for guiding the club for efficient stroking thereof throughout the backswing, downswing and follow-through, said supporting means comprising a base structure adapted to lie on a generally horizontal surface and a framework on the base structure for supporting said ring member in position above the base structure in a plane at a selected angle to the horizontal surface with the ring member having a lower portion in front of the golfer at a relatively low elevation with respect to said surface and an upper portion in back of the golfer at a relatively high elevation with respect to said surface, said framework comprising forward ring member support means on the base structure supporting said lower portion of the ring member and permitting variation of the angle of the plane of said ring member, and rearward articulated prop means for propping up said upper portion of the ring member, said rearward articulated prop means being pivoted at one end thereof constituting its lower end on the base structure for angular adjustment about a generally horizontal axis extending transversely with respect to the base structure generally adjacent said surface and pivotally connected at the other end thereof constituting its upper end to said upper portion of the ring member, articulation of the said prop means enabling adjustment of the elevation of said upper portion of the ring member and the angle of the plane of the ring member;

height indicating means on the framework for setting the elevation of the ring member to correspond with a predetermined height setting based on the height of the golfer; and angle indicating means associated with the framework for setting the angle of the plane of the ring member to correspond with a predetermined angle setting based on the club being swung by the golfer.

* * * * *